US005658850A

United States Patent [19]

Taniguchi et al.

[11] Patent Number: 5,658,850

[45] Date of Patent: Aug. 19, 1997

[54] IMAGE SUPPORTING SHEET

[75] Inventors: Keishi Taniguchi, Susono; Hidehiro Mochizuki, Numazu, both of Japan

[73] Assignee: Ricoh Company, Ltd., Tokyo, Japan

[21] Appl. No.: 631,771

[22] Filed: Apr. 12, 1996

[30] Foreign Application Priority Data

Apr. 12, 1995 [JP] Japan ..... 7-086800
Jun. 2, 1995 [JP] Japan ..... 7-136581

[51] Int. Cl.[6] ..... B41M 5/035; B41M 5/38

[52] U.S. Cl. ..... 503/227; 428/195; 428/198; 428/423.1; 428/447; 428/475.5; 428/480; 428/500; 428/522; 428/913; 428/914

[58] Field of Search ..... 8/471; 428/195, 428/198, 423.1, 447, 475.5, 480, 500, 522, 913, 914; 503/227

[56] References Cited

U.S. PATENT DOCUMENTS 5,348,931 9/1994 Mochizuki et al. ..... 503/227
5,376,319 12/1994 Arima ..... 264/46.1
5,432,145 7/1995 Oshima et al. ..... 503/227

*Primary Examiner*—Bruce H. Hess
*Attorney, Agent, or Firm*—Oblon, Spivak, McClelland, Maier & Neustadt, P.C.

[57] ABSTRACT

An image supporting sheet, preferably for sublimation thermal transfer recording, which has excellent resistance to heat, light, solvents, scratch, and alteration.

The image supporting sheet including:

(a) a substrate;

(b) a dye receiving layer which includes a resin and a releasing agent formed on the substrate;

(c) a dye image diffused into the dye receiving layer; and (d) a clear protective film adhered to the dye receiving layer by an adhesive agent;

wherein the adhesive agent includes at least one of a cyanoacrylate compound and a thermoplastic polyurethane resin, and preferably, the clear protective film includes an ultraviolet stabilizer, and/or at least one of the dye receiving layer and the adhesive agent includes at least one of an ultraviolet stabilizer, a photo-stabilizer, an antioxidant and a quencher.

21 Claims, No Drawings

IMAGE SUPPORTING SHEET

BACKGROUND OF THE INVENTION

1. Field of the Invention

The present invention relates to an image supporting sheet, and more particularly to an image supporting sheet for sublimation thermal transfer recording wherein a recorded image has excellent resistance to heat, light, solvents, scratch and alteration.

2. Discussion of Background

Recently, the demand for full color printing has been increasing year by year. There have been known recording methods for full color printing including the electrophotographic method, the ink jet method and the thermal transfer method. Among these methods, the thermal transfer method is most widely employed because of its advantages such as easy maintenance and low noise operation.

The thermal transfer recording methods can be roughly classified into two types, a thermofusing thermal transfer recording and a sublimation thermal transfer recording.

In the thermofusing thermal transfer recording, an image can be obtained by applying heat to the backside of a thermofusing thermal transfer recording sheet superimposed on a image receiving sheet. The thermofusing thermal transfer recording sheet has a substrate and an ink layer, formed on the substrate, which has a coloring agent dispersed in a thermofusible material, and when applying heat to form an image, the ink layer melts and transfers to the image receiving sheet, so that an image is obtained.

In the sublimation thermal transfer recording, an image can be also obtained by applying heat to the backside of sublimation thermal transfer recording sheet superimposed on a dye receiving layer formed on a image receiving sheet. The sublimation thermal transfer recording sheet has a substrate and an ink layer, formed on the substrate, which has a thermo-diffusional dye (hereinafter a sublimable dye) dispersed in a binder resin, and when applying heat to form an image, the sublimable dye diffuses into the dye receiving layer, so that an image is obtained.

When these two recording methods are compared for full color printing, the sublimation thermal transfer recording is superior to the thermofusing thermal transfer recording because of advantages such as high resolution and high fidelity of color tone and half tone.

However, the sublimation thermal transfer recording method costs more to run than these other methods, because:

(a) a sublimable dye is very expensive;

(b) yellow, magenta, cyan, and, when necessary, black image transfer recording sheets, each individually being of equal size to the recorded image, are needed to obtain a full color image; and (c) a used sublimation thermal transfer recording sheet must be disposed even though there is a large unused part of the recorded sheet.

To eliminate this shortcoming, the so-called multiple sublimation thermal transfer recording methods have been proposed. The multiple sublimation thermal recording methods include the n-times (n>1) mode recording method and the n-fold speed mode recording method.

The n-times mode recording method means that a sublimation thermal transfer recording sheet is repeatedly printed n-times under the condition of the same printing speed as an image receiving sheet.

The n-fold speed mode recording method means that a sublimation thermal transfer recording sheet is printed under the condition of the 1/n printing speed to an image receiving sheet.

An image printed by the n-fold speed mode recording method is superior to an image printed by the n-times mode recording method because of advantages such as good evenness of the image and no wrinkling of the thermal transfer recording sheet in printing.

In the n-fold speed printing, since the sublimation thermal transfer recording sheet and the image receiving sheet are run at different speeds in printing, a strong friction force occurs between the sublimation thermal transfer recording sheet and the image receiving sheet, so that the two sheets tend to stick to each other or are damaged. Accordingly, the image receiving sheet used in n-fold speed mode printing is required to be more resistant to heat of printing and more lubricating to the sublimation thermal transfer recording sheet than in n-times mode printing. To address this problem, it has been proposed to include a releasing agent, such as a silicone oil and a silicone resin in the dye receiving layer of the image receiving sheet.

In other than n-fold speed mode printing, namely, in the case of normal sublimation printing, a releasing agent has also been employed to a dye receiving layer to improve releasability from the sublimation thermal transfer recording sheet. (JP-A 64-44781)

Furthermore, the sublimation thermal transfer recording has a shortcoming in that the printed image tends to change color or fade away by heat and light, particularly, ultraviolet rays. Recently, an image printed by the sublimation thermal transfer recording method has also been used as a recording material for identification cards, so that it is necessary to prevent the image from alteration. To address this subject, it has been proposed that an image printed by sublimation thermal recording method be covered or laminated by a clear protective film.

However, it is difficult to cover or laminate a clear protective film on an image receiving sheet because the dye receiving layer of the receiving sheet which includes a releasing agent such as a silicone oil and a silicone resin has a very low surface energy.

Unfortunately, due to all of these reasons, a need exists for an image supporting sheet, printed by a sublimation thermal transfer recording method, wherein a recorded image has excellent resistance to heat, light, solvents, scratch, and alteration.

SUMMARY OF THE INVENTION

It is therefore an object of the present invention to provide an image supporting sheet, preferably for sublimation thermal transfer recording, wherein a recorded image has excellent resistance to heat, light, solvents, scratch, and alteration.

The object of the present invention can be achieved by an image supporting sheet which includes:

(a) substrate;

(b) a dye receiving layer, formed on the substrate, which includes a resin and a releasing agent; (the combination of (a) and (b) hereinafter referred to as an image receiving sheet), (c) a dye image diffused into the dye receiving layer by a sublimation thermal transfer recording method; and (d) a clear protective film adhered to the image printed dye receiving layer by an adhesive agent; (the combination of (a), (b), (c) and (d) hereinafter referred to as an image supporting sheet), wherein the adhesive agent includes at least one of a cyanoacrylate compound and a thermoplastic polyurethane resin.

The image of the image supporting sheet of the present invention has excellent resistance to heat, light, solvents and scratch because the clear protective film protect the image from heat, light, particularly ultraviolet rays, solvents and scratch.

It is preferable for obtaining better light resistance that the clear protective film include an ultraviolet stabilizer and/or at least one of the dye receiving layer and the adhesive agent includes at least one of an ultraviolet stabilizer, a photo-stabilizer, an antioxidant, and a photo-reaction quencher for preventing a reaction of an excited molecule (hereinafter referred to a quencher).

In addition, the image supporting sheet of the present invention has an ability to prevent alteration of the image because the adhesion between the clear protective film and the dye receiving layer is very strong, so that, even when peeling the clear protective film to alter the image, the image is destroyed and thus cannot be altered.

DESCRIPTION OF THE PREFERRED EMBODIMENTS

The present invention is predicated upon the discovery that an image supporting sheet, wherein a recorded image has excellent resistance to heat, light, solvents, scratch, and alteration, can be prepared by superimposing a clear protective film on the imagewise printed dye receiving layer by an adhesive agent including at least one of a cyanoacrylate compound and a thermoplastic polyurethane resin.

The present invention is also predicated upon the discovery that an image supporting sheet having superior resistance to light can be prepared by including an ultraviolet stabilizer in the clear protective film and/or including at least one of an ultraviolet stabilizer, a photo-stabilizer, an antioxidant and a quencher.

The image supporting sheet of the present invention includes an image receiving sheet on which an image is printed by a sublimation thermal transfer recording method, and a clear protective film superimposed on the image receiving sheet by an adhesive agent.

As the substrate for use in the image receiving sheet of the present invention, any known substrate for use in the conventional image supporting sheets can be employed. For example, a paper, a synthetic paper, an art paper, a coated paper, a photogravure paper, a baryta paper, and a plastic film are preferably employed. The preferable thickness of a substrate is from 4 to 250 μm.

As the resin in the dye receiving layer for use in the image receiving sheet of the present invention, any known resin which is dyeable to sublimable dyes can be employed. For example, polyester resin, polyvinyl chloride resin, acrylic resin, polyurethane resin, polyvinyl acetate resin and polyamide resin are preferably employed. It is preferable to improve the dye receiving layer to make it more resistant to heat and more releasable from a sublimation thermal transfer recording sheet by using a resin having an active hydrogen and curing it with a crosslinking agent such as an isocyanate compound and/or a melamine resin.

As the isocyanate compound for use in the dye receiving layer of the present invention, which may be employed individually or in combination, any known isocyanate compound can be employed. For example, diisocyanate or triisocyanate compounds are preferably employed.

Specific examples of those isocyanate compounds are as follows:

2,4-tolylenediisocyanate, 2,6-tolylenediisocyanate, 4,4-diphenylmethanediisocyanate, hexamethylenediisocyanate, xylylenediisocyanate, triphenylmethanetriisocyanate, isophoronediisocyanate, bisisocyanatemethylcyclohexane, and trimethylhexamethylenediisocyanate.

As the melamine resin for use in the dye receiving layer of the present invention, any known melamine resin, for example, methoxymethylmelamine resin and n-butoxymethylmelamine resin, can be employed.

In addition, the dye receiving layer of the present invention includes a releasing agent to prevent the dye receiving layer from sticking to the sublimation thermal transfer recording sheet in printing. Specific examples of the releasing agent are liquid paraffins, unmodified silicone oils, modified silicone oils, silicone resins, synthetic lubricants such as copolymers of polyoxyalkyleneglycols and silicones, fluorine-containing resins, fluorine-containing surface active agents such as fluoroalkyl compounds, fluorine-containing lubricants such as trifluorochloroethylene oligomers, paraffin wax, polyethylene wax, higher fatty alcohols, higher alcohol amides of higher fatty acids, ester of higher fatty acids and salts of higher fatty acids. Among those releasing agents, a silicone compound such as silicone resin, silicone varnish, silicone oil and their derivatives are preferable because of advantages such as good releasing from the sublimation thermal transfer recording sheet and no blurring of the print image with the elapse of time. The silicone oil for use in the present invention includes both unmodified silicone oil and modified silicone oil.

Specific examples of unmodified silicone oils are dimethylsilicone, methylphenylsilicone and methylhydrodienesilicone. The kinetic viscosity of the unmodified silicone oil is preferably from 500 to 2000 cs. When the kinetic viscosity is in the range above-mentioned, the dye receiving layer can be coated uniformly and has excellent resistance to sticking to the sublimation thermal transfer recording sheet in printing. As the modified silicone oil for use in the present invention, modified compounds of the above-mentioned unmodified silicone oils can be employed.

Specific examples of those modified silicone oils are alcohol-modified, polyether-modified, carboxy-modified, epoxy-modified, alkyl-modified, fluorine-modified, amino-modified, phenol-modified and mercapto-modified silicone oil.

The preferable content of the releasing agent to the resin of the dye receiving layer is from 2 to 15 wt. %. The releasing agent may uniformly be included in the dye receiving layer, or partially included at the surface of the dye receiving layer in such a way that a dye receiving layer including a releasing agent is formed on a dye receiving layer including no releasing agent.

Furthermore, the dye receiving layer of the present invention preferably includes an ultraviolet stabilizer, photo-stabilizer, an antioxidant and a quencher to improve the resistance of the image to light.

Specific examples of the ultraviolet stabilizer are the same as the compounds described later in the clear protective film.

Specific examples of the photo-stabilizer, the antioxidant, and the quencher are the same as the compounds described later in the adhesive agent.

Furthermore, if desired, auxiliary components which are used in a conventional receiving sheet for a sublimation thermal transfer recording such as a filler, a fluorescent brightening agent and a surface active agent can be added to the dye receiving layer.

A filler and a fluorescent brightening agent are added to the dye receiving layer to improve the whiteness of the image receiving sheet.

Specific examples of the filler are inorganic white pigments such as titanium dioxide, zinc oxide, silica, calcium carbonate and clay, and organic white pigments such as fluorinated resin.

Specific examples of the fluorescent brightening agent are derivatives of anthraquinone, indigo, azine, xanthene, acrydine, diphenylmethane, triphenylmethane, thiazine, thiazole and stilbene.

The preferable content of the ultraviolet stabilizer, the photo-stabilizer, the antioxidant, the quencher or the auxiliary components is from 0.001 to 0.70 parts by weight per 1 part by weight of the resin of the dye receiving layer.

The clear protective film of the present invention is formed on the image receiving layer for improving the resistance of the image to heat, light, solvents and scratch, and preventing the image from alteration. As the clear protective film for use in the present invention, a clear film of thickness of from 5 to 200 μm, more preferably, from 20 to 100 μm, can be employed.

Specific examples of film materials include polyester, nylon resin, polyvinyl chloride, polyvinylidene chloride, polyvinyl fluoride, polyacrylonitrile, polystyrene, polycarbonate, acrylic resin, polyamide, polyimide, polyethersulfone, polyphenylenesulfide, cellulose resin, polyvinyl alcohol, polyvinyl acetate, polyvinyl butyral, polyvinyl acetal, polyvinyl pyrrolidone, polyacrylamide, polydivinylbenzene, polyvinyl benzene, styrene-butadiene copolymer, polyethylene and polypropylene. Among these clear films, a film having an oxygen transmittance of less than 150 cc/($m^2$·24 hr.·atm·25 μm) and a steam transmittance of less than 100 g/($m^2$·24 hr.·atm·25 μm), such as polyvinylidene chloride, nylon resin, polyvinyl chloride, polyvinyl fluoride and polyacrylonitrile, are preferable in view of preventing changing and fading of the colored image.

In addition, an ultraviolet stabilizer is preferably included in the clear protective film for preventing the colored image from color changing and fading by light.

Specific examples of the ultraviolet stabilizer are as follows:

salicylate compounds:

phenylsalicylate, p-tert-butylphenylsalicylate, p-octylphenylsalicylate, benzophenone compounds:

2,4-dihydroxybenzophenone, 2-hydroxybenzophenone, 2-hydroxy-4-octoxybenzophenone, 2-hydroxy-4-dodecyloxybenzophenone, 2,2'-dihydroxy-4-methoxybenzophenone, 2,2'-dihydroxy-4,4'-dimethoxybenzophenone, 2-hydroxy-4-methoxy-5-sulfobenzophenone, benzotriazole compounds:

2-(2'-hydroxy-5'-methylphenyl)benzotriazole, 2-(2'-hydroxy-5'-tert-butylphenyl)benzotriazole, 2-(2'-hydroxy-3'-tert-butyl-5'-methylphenyl) benzotriazole, 2-(2'-hydroxy-3',5'-di-tert-butylphenyl)-5-chlorobenzotriazole, 2-(2'-hydroxy-3',5'-di-tert-amylphenyl)benzotriazole, cyanoacrylate compounds:

2-ethylhexyl-2-cyano-3,3'-diphenylacrylate, ethyl-2-cyano-3,3'-diphenylacrylate, metal oxide compounds:

titanium dioxide, zinc oxide, cerium oxide, other compounds:

anilide oxalate, triazine compounds, dibenzoylmethane compounds, and benzylidene compounds.

The methods of incorporating an ultraviolet stabilizer in the clear protective film are, for example, as follows:

(a) making a film of a kneaded mixture of a resin and an ultraviolet stabilizer by an extrusion process;

(b) making a film by the following process:

1) preparing a solution by dissolving a resin and an ultraviolet stabilizer in a solvent, 2) coating the solution on a temporary substrate, and drying the coated liquid to form a film, and 3) peeling the film off the temporary substrate.

(c) making a film by the following process:

1) preparing a solution by dissolving a binding resin and an ultraviolet stabilizer in a solvent, and 2) coating the solution on a clear protective film, and drying the coated liquid.

Hereinafter this coated layer is referred to an ultraviolet rays absorbing layer.

The adhesive agent of the present invention strongly adheres the clear protective film to the dye receiving layer, so that the image of the image supporting sheet has excellent resistance to heat, light, solvents, scratch, and alteration. As the adhesive agent for use in the present invention, a cyanoacrylate compound and/or a thermoplastic polyurethane resin is preferably employed.

The cyanoacrylate compound for use in the present invention is represented by the following formula:

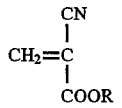

wherein R is alkyl, optionally interrupted by an ether and/or thioether group.

In addition, the cyanoacrylate compound may be used with auxiliary components and/or copolymerized with other monomers.

Specific examples of auxiliary components are as follows:

(a) plasticizers:

Any known plasticizer for adhesive agents can be employed.

(b) polymers:

diene polymer, such as butadiene,
polyalkyl α-cyanosolbinate,
polyalkyl α-cyano β-vinylacrylate, and
polyisocyanate, (c) agents increasing the viscosity of a coating liquid:

nitrocellulose, polyacrylate, poly α-cyanoacrylate, and polydiallylphtalate, (d) isocyanate compounds:

Any known isocyanate compound presently used in adhesive agents can be employed for increasing adhesive force, (e) acids or bases:

Any known acid presently used in adhesive agents can be employed for controlling vulcanization, and any known base can be employed for promoting vulcanization, (f) vaporable inhibitors for ion polymerization causing the deterioration of the coating liquid;

$SO_2$ gas, and the like, (g) inhibitors for radical polymerization causing deterioration of the coating liquid:

hydroquinone, and the like.

Specific examples of the monomer for copolymerizing with cyanoacrylate compounds are as follows:

vinylidenecyanide, alkylacrylate, alkylmethacrylate, vinylacetate, vinylbutylate, acrylonitrile, alkyl α-cyanosolbinate, and alkyl α-cyano β-vinylacrylate.

The preferable methods of adhering the clear protective film on the dye receiving layer with a cyanoacrylate compound adhesive agent are as follows:

(a) coating the cyanoacrylate compound, or if desired, mixed with a monomer to be copolymerized with the cyanoacrylate compound and auxiliary components, in such patterns as spots, lines or planes on the image printed dye receiving layer and/or the clear protective film, and then superimposing the clear protective film on the dye receiving layer, and adhering each to the other; or (b) coating a micro-capsulated cyanoacrylate compound, or if desired, mixed with a monomer to be copolymerized and auxiliary components, in such patterns as spots, lines or planes on the image printed dye receiving layer and/or the clear protective film, and then superimposing the clear protective film on the dye receiving layer, and adhering each to the other by applying heat and/or pressure.

The thermoplastic polyurethane resin for use in the adhesive agent of the present invention can be made by addition polymerization of a high molecular weight diol, a diisocyanate, and if desired, another monomer.

The melting point of the thermoplastic polyurethane is preferably less than 250° C. When the melting point is more than 250° C., adhering between the clear protective film and the dye receiving layer by heat and pressure is not always possible, and even if possible, problems of blurring of the image and deformation of the clear protective film can occur.

Specific examples of the high molecular weight diol are as follows:

polyether compounds:

polypropylene glycol, polyethylene glycol, polytetramethylene glycol, ethylene oxide/propylene oxide copolymer, tetrahydrofuran/ethylene oxide copolymer, and tetrahydrofuran/propylene oxide copolymer, polyester compounds:

poly (ethylene adipate), poly(diethylene adipate), poly (propylene adipate), poly(tetramethylene adipate), poly (hexamethylene adipate), poly(neopentylene adipate), random copolymer of poly(ethylene adipate) and poly (diethylene adipate), random copolymer of poly(ethylene adipate) and poly(propylene adipate), random copolymer of poly(ethylene adipate) and poly(tetramethylene adipate), and random copolymer of poly(hexamethylene adipate) and poly(neopentylene adipate), other compounds:

poly-ε-caprolactone, poly(hexamethylenecarbonate), and silicone polyol.

Specific examples of the diisocyanate compound are as follows:

aromatic diisocyanate compounds:

4,4'-methylenediisocyanate, 2,4'-methylenediisocyanate, 2,4-tolylenediisocyanate, 2,6-tolylenediisocyanate, and naphtalenedilsocyanate, aliphatic diisocyanate compounds:

hexamethylenediisocyanate, tetramethylenediisocyanate, isophoronediisocyanate, xylylenediisocyanate, cyclohexanediisocyanate, and hydrogenated methylenediisocyanate.

Specific examples of the other monomer are as follows:

1,4-butanediol, 1,6-hexanediol, ethyleneglycol, hydroquinone, diethylolether, and amines.

In addition, if desired, auxiliary components which improve the resistance to light, such as an ultraviolet stabilizer, photo-stabilizer, an antioxidant and a quencher, can be added to the adhesive agent in the present invention.

Specific examples of the ultraviolet stabilizer are the afore-mentioned compounds in the clear protective film.

The photo-stabilizer prevents deterioration of the sublimated dye image by effectively catching and inactivating the radicals generated from the sublimated dye image by ultraviolet rays.

Specific examples of the photo-stabilizer are as follows:

hindered amines:

4-benzoyloxy-2,2,6,6-tetramethylpiperidine, bis(2,2,6,6-tetramethyl-4-piperidil)sebacate, bis(1,2,2,6,6-pentamethyl-4-piperidil)sebacate, 2-(3,5-di-tert-butyl-4-hydroxybenzyl)-2-n-butylmalonic-acid bis(1,2,2,6,6-pentamethyl-4-piperidil), and tetrakis(2,2,6,6-tetramethyl-4-piperidil)-1,2,3,4-butanetetracarboxylate, hindered phenols:

2,4-di-tert-butylphenyl-3,5-di-tert-butyl-hydroxybenzoate, nickel complexes:

(2,2'-thiobis(4-tert-butylphenolate))-tert-butyl aminenickel (II), and (2,2'-thiobis-(4-tert-butylphenolate))-2-ethylhexylaminenickel(II), nickel salt of phosphoric acid ester:

nickel salt of 3,5-di-tert-butyl-4-hydroxybenzyl-phosphoric acid monomethyl ester.

The antioxidants are classified into two types. The first is a radical-receiving antioxidant which stabilizes the sublimated dye image by providing protons to join to radical peroxides generated from the sublimated dye image. The second is a peroxide-decomposing antioxidant which stabilizes the sublimated dye image by changing hydroperoxides, generated from the sublimated dye image, to stable alcohols. Both types of antioxidants can be employed for the present invention.

Specific examples of the radical-receiving antioxidant are as follows:

phenolic compounds:

hydroquinone, gallate, 2,6-di-tert-butyl-p-cresol, stearyl-β(3,5-di-tert-butyl-4-hydroxyphenyl)-propionate, 2,2'-methylenebis(4-methyl-6-tert-butylphenol), 2,2'-methylenebis(4-ethyl-6-tert-butylphenol), 4,4'-thiobis (3-methyl-6-tert-butylphenol), 1,1,3-tris(2-methyl-4-hydroxy-5-tert-butylphenyl)-butane, 1,3,5-trimethyl-2,4,6-tris(3,5-di-tert-4-hydroxybenzyl)benzene, tris(3,5-di-tert-butyl-4-hydroxybenzyl)isocyanurate, and tetrakis(methylene-3(3',5'-di-tert-butyl-4-hydroxyphenyl) propionate)methane, amines:

N,N'-diphenyl-p-phenylenediamine, phenyl-β-naphtylamine, phenyl-α-naphtylamine, N,N'-β-naphtyl-p-phenylenediamine, N,N'-diphenylethylenediamine, phenothiadine, N,N'-di-sec-butyl-p-phenylenediamine, and 4,4'-tetramethyl-diaminodiphenylmethane.

Specific examples of the peroxide-decomposing antioxidant are as follows:

sulfuric compounds:

dilaurylthiodipropionate, distearylthiodipropionate, laurylstearylthiodipropionate, dimyristylthiodipropionate, distearyl β, β'-thiodibutylate, 2-mercaptobenzoimidazole, and dilaurylsulfide, phosphoric compounds:

triphenylphosphite, trioctadecylphosphite, tridecylphosphite, trilauryltrithiophosphite, diphenylisodecylphosphite, trinonylphenylphosphite, and distearylpentaerythritolphosphite.

The quencher stabilizes the sublimated dye image by preventing a reaction of an excited molecule of the sublimated dye image by absorbing the excited energy therefrom.

Specific examples of the quencher are a variety of known metal complexes.

The preferable method of adhering the protective clear film on the dye receiving layer with a thermoplastic polyurethane resin adhesive agent is as follows:

(a) the protective clear film on which the adhesive layer is formed by coating a solution of the thermoplastic polyurethane resin and a solvent by means of a wire bar or a doctor blade, and drying the coated solution, is provided, and then superimposed on the image printed dye receiving layer, and adhered by heat and pressure.

A preferable sublimation thermal transfer recording sheet for use in combination with the image receiving sheet of the present invention includes:

(a) a substrate, (b) an adhesive resin layer formed on the substrate, (c) a dye-supplying layer formed on the adhesive resin layer, including a sublimable dye dissolved or dispersed in a binder, (d) a dye-transferring layer formed on the dye-supplying layer, including a lower concentration sublimable dye dissolved or dispersed in a binder than that of the dye-supplying layer, and (e) a low dyeable resin layer formed on the dye-transferring resin layer.

As the substrate for use in the sublimation thermal transfer recording sheet of the present invention, any known substrate for use in the conventional sublimation thermal transfer recording sheet can be employed. For example, a condenser paper and plastic film, such as polyester, polyethylene naphthalate, polystyrene, polysulfone, polyimide, polyvinyl alcohol, cellophane and aromatic polyamide of thickness of from 2 to 50 pm are preferably employed.

The sublimable dye for use in the present invention can be a sublimable disperse dye, an oil-soluble dye and a basic dye. The molecular weight of the sublimable dye is preferably from 150 to 800, more preferably, from 350 to 700.

Specific examples of sublimable dye are as follows:

C.I. Disperse Yellows 51, 3, 54, 79, 60, 23, 7, and 141;

C.I. Disperse Blues 24, 56, 14, 301, 334, 165, 19, 72, 87, 287, 154 and 26;

C.I. Disperse Reds 35, 146, 59, 1, 73, 60 and 167;

C.I. Disperse Violets 4, 13, 35, 56 and 31;

C.I. Solvent Violet 13;

C.I. Solvent Black 3;

C.I. Solvent Green 3;

C.I. Solvent Yellows 56, 14, 16 and 29;

C.I. Solvent Blues 70, 35, 63, 36, 50, 49, 111, 105, 97 and 11;

C.I. Solvent Reds 135, 81, 18, 25, 19, 23, 24, 143, 146 and 182.

The binder for use in the dye-supplying layer and the dye-transfer layer can be ethylcellulose, hydroxyethylcellulose, ethylhydroxycellulose, hydroxypropylcellulose, methylcellulose, cellulose acetate, cellulose acetate butyrate, polyester, polyvinyl acetate and polyacrylamide.

The preferred examples of the low dyeable resin are aromatic polyester resin, polyamide resin, (meth)acrylate resin, styrene-maleic acid ester copolymer, polyimide resin, acetate resin, silicone resin, styrene-acrylonitrile copolymer and polysulfone resin.

The sublimation thermal transfer recording method is carried out by the following process:

(a) superimposing a sublimation thermal transfer sheet on an image receiving sheet;

(b) applying heat to the thermal transfer recording sheet by a thermal print head and the like to diffuse a sublimable dye, contained in the dye-supplying layer and the dye-transferring layer, into the dye receiving layer of the image receiving sheet in a different running speed mode, in which both of the thermal transfer recording sheet and the dye receiving sheet are caused to run with the running speed of the thermal transfer recording sheet being set at 1/n (n>1) times the running speed of the image receiving sheet.

Other features of the present invention will become apparent from the following description of exemplary embodiments, which are provided solely for purpose of illustration and are not intended to be limitative.

EXAMPLES

EXAMPLE 1

Preparation of an image receiving sheet

The following dye receiving layer coating liquid was prepared, coated on a foamed PET film W900E manufactured by Diafoil Corp., and dried. The coated film was heated at 60° C. for 50 hours to prepare a image receiving sheet having a dye receiving layer of 6 μm thick.

Formulation of dye receiving layer coating liquid:

| | parts by weight |
|---|---|
| vinyl chloride/vinyl acetate/vinyl alcohol copolymer VAGH, (manufactured by Union Carbide Corp.,) | 15 |
| isocyanate compound Colonate L, (manufactured by Nippon Polyurethane Industry Co., Ltd.) | 5 |
| unmodified silicone oil SH200, (manufactured by Toray Silicone Industries, Inc.) | 0.5 |
| alcohol modified silicone oil SF8427 (manufactured by Toray Silicone Industries, Inc.) | 0.5 |
| toluene | 40 |
| methyl ethyl ketone | 40 |

Preparation of a thermal transfer recording sheet

A thermal transfer recording sheet was prepared by applying an intermediate adhesive layer coating liquid for forming an intermediate adhesive layer on an aromatic polyamide film of 6 μm in thickness having a silicone resin heat-resistant back coated layer of 1 μm thick by means of a wire bar, drying at 120° C. for 90 seconds and aging at 60° C. for 24 hours to form an intermediate adhesive layer of 1 μm thick. Then a dye-supplying layer was coated thereon in a thickness of 3 μm on a dry basis, further thereon a dye-transferring layer was coated in a thickness of 1 μm on a dry basis and still further thereon a low-dyeable resin layer was coated in a thickness of 1 μm on a dry basis. After each of these coatings the layer was dried at 100° C. for 90 seconds and aged at 60° C. for 24 hours.

| | parts by weight |
|---|---|
| Formulation of intermediate adhesive layer: | |
| polyvinyl butyral resin BX-1 (manufactured by Sekisui Chemical Co.) | 10 |
| isocyanate compound Colonate L | 10 |
| toluene | 95 |
| methyl ethyl ketone | 95 |
| Formulation of dye-supplying layer coating liquid: | |
| polyvinyl butyral resin BX-1 | 10 |
| isocyanate compound Colonate L | 5 |
| sublimable dye HSO-144 (manufactured by Mitsui Toatsu Dye Chemical, Inc.,) | 30 |
| ethanol | 180 |
| n-butanol | 10 |
| Formulation of dye-transferring layer coating liquid: | |
| polyvinyl butyral BX-1 | 10 |
| isocyanate compound Colonate L | 5 |
| toluene | 95 |
| methyl ethyl ketone | 95 |
| Formulation of low-dyeable layer coating liquid: | |
| styrene/maleic acid copolymer Suprapal AP (manufactured by BASF Ltd.) | 10 |
| liquid A | 12 |
| tetrahydrofuran | 20 |
| methyl ethyl ketone | 95 |

The liquid A was prepared by dissolving 15 g of dimethyl methoxy silane and 9 g of methyl trimethoxy silane in a mixture of 12 g of toluene and 12 g of methyl ethyl ketone, and hydrolyzing with addition of 13 ml of 3% sulfuric acid.

The method of recording

The sublimation thermal transfer recording sheet was superimposed on the image receiving sheet such that the low-dyeable resin layer of the sublimation thermal transfer recording sheet was brought into contact with the dye receiving layer of the image receiving sheet, and then a cyan-colored image was printed by a thermal print head under the following conditions:

| | |
|---|---|
| applied energy to the thermal print head | 2.21 mJ/dot |
| running speed of the image receiving sheet | 8.4 mm/sec |
| running speed of the sublimation thermal transfer recording sheet | 0.6 mm/sec |

Preparation of image supporting sheet

A PET film of 50 μm in thickness, used as a clear protective film, was superimposed on the dye receiving layer on which a jellied instantaneous cyanoacrylate adhesive agent (Power Ace, manufactured by Sekisui Chemical Co.) was coated to be a thin and uniform layer. Thus, an image supporting sheet was obtained.

Comparative Example 1

The procedure for preparation of the image supporting sheet in Example 1 was repeated except that the cyanoacrylate adhesive agent was replaced by a epoxy two-liquids-type room temperature vulcanizing adhesive agent (AP-400, manufactured by Toa Gosei Chemical Industry Co.).

EXAMPLE 2

The procedure for preparation of the image supporting sheet in Example 1 was repeated except that there was an ultraviolet rays absorbing layer formed on the 50 μm PET film by 2 μm in thickness. The formulation of the ultraviolet rays absorbing layer coating liquid (named as Liquid A) was as follows:

| (Liquid A) | parts by weight |
|---|---|
| phenylene salicylate | 3 |
| polyester resin Vylon 200 (manufactured by Toyobo Co.) | 15 |
| methyl ethyl ketone | 31 |
| toluene | 50 |

EXAMPLE 3

The procedure for preparation of the image supporting sheet in Example 1 was repeated except that the preparation of the image supporting sheet in Example 1 was replaced by the following preparation.

Preparation of image supporting sheet

A PET film of 50 μm in thickness on which the thermoplastic polyurethane solution (Takerac T-3500A, manufactured by Takeda Chemical Industries, Ltd., of which solid content is 24.5 wt. %.) was coated by means of a wire bar and dried to be a uniform layer of 10 μm in dry thickness was prepared as a clear protective film with an adhesive layer. Then the clear protective film was superimposed on the dye receiving layer of the image receiving sheet such that the adhesive agent was brought into contact with the dye receiving layer, and heated by a heat block for 1 second under the condition of 150° C. in temperature and 2 kgf/cm$^2$ in pressure.

EXAMPLE 4

The procedure for preparation of the image supporting sheet in Example 3 was repeated except that a photostabilizer (Sanol LS-765, manufactured by Sankyo Co.) was present in the thermoplastic polyurethane solution in an amount of 3 wt. % of solids of the thermoplastic polyurethane resin.

EXAMPLE 5

The procedure for preparation of the image supporting sheet in Example 4 was repeated except that the 50 μm PET film used for the clear protective film was replaced by the 50 μm PET film with the ultraviolet rays absorbing layer of 2 μm thick in Example 2.

EXAMPLE 6

The procedure for preparation of the image supporting sheet in Example 5 was repeated except that the photostabilizer added to the thermoplastic polyurethane resin was replaced by an antioxidant (Adekastab AO-20, manufactured by Asahi Denka Kogyo Co.).

EXAMPLE 7

The procedure for preparation of the image supporting sheet in Example 3 was repeated except that an ultraviolet stabilizer, 2-(2'-hydroxy-5-methylphenyl)benzotriazole, was present in the thermoplastic polyurethane solution in an amount of 3 wt. % of the solids of the resin.

EXAMPLE 8

The procedure for preparation of the image supporting sheet in Example 3 was repeated except that a hindered amine photo-stabilizer (Sanol-765) was present in the dye receiving layer coating liquid in an amount of 5 wt. % to the vinylchloride/vinyl acetate/vinyl alcohol copolymer.

In accordance with the following method, each of the image supporting sheets according to the present invention obtained in Examples from 1 through 6 and the comparative image supporting sheet in Comparative Example 1 was evaluated with respect to altering of the image and light resistance of the image supporting sheets.

The results are given in Table 1.

Evaluation test method (1) Image alteration test

After 10 minutes later of adhering the protective clear film to the image receiving sheet, the protective clear film was peeled, and whether the printed image was alterable was checked. The results of the evaluation were classified as follows:

X: There was no change of the printed image by peeling the clear protective film and the image was alterable.

O: The printed image was destroyed by peeling the clear protective layer and the image was not alterable.

(2) Light resistance test

The image side of the image supporting sheet was exposed to light for 30 hours using a Xenon weathering tester. Each of the optical density of the images before and after light exposure was measured by Macbeth reflection densitometer RD-918, manufactured by Macbeth Co.

TABLE 1

| | light resistance test | | image |
|---|---|---|---|
| | image density before test | image density after test | altering test |
| Example 1 | 1.62 | 1.21 | O |
| Example 2 | 1.62 | 1.57 | O |
| Example 3 | 1.62 | 1.22 | O |
| Example 4 | 1.62 | 1.56 | O |
| Example 5 | 1.62 | 1.60 | O |
| Example 6 | 1.62 | 1.61 | O |
| Example 7 | 1.62 | 1.59 | O |
| Example 8 | 1.61 | 1.57 | O |
| Comparative Example 1 | 1.62 | 1.61 | X |

As may be observed from the Table 1, the image supporting sheets of the present invention maintain high image density when exposed to light, particularly in the case of including an ultraviolet stabilizer, a photo-stabilizer, and an antioxidant, and have the ability to prevent the image from alteration in comparison with the comparative example because the clear protective film strongly adhered to the image receiving sheet.

Having described the present invention, it will be apparent to the artisan that many changes and modifications may be made to the above-described embodiments without departing from the spirit and scope of the present invention.

The disclosure of Japanese priority applications JPAP 07-086800 filed Apr. 12, 1995 and JPAP 07-136581 filed Jun. 2, 1995 is hereby incorporated by reference.

What is claimed as new and desired to be secured by Letters Patent of the United States is:

1. An image supporting sheet comprising:

(a) a substrate;

(b) a dye receiving layer, which comprises a resin and a releasing agent, formed on said substrate;

(c) a dye image diffused into said dye receiving layer; and (d) a clear protective film adhered to said dye receiving layer by an adhesive agent, wherein said adhesive agent comprises at least one of a cyanoacrylate compound and a thermoplastic polyurethane resin.

2. The image supporting sheet of claim 1, wherein said cyanoacrylate compound has the following formula:

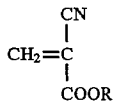

wherein R is alkyl, optionally interrupted by an ether and/or thioether group.

3. The image supporting sheet of claim 1, wherein said clear protective film has an oxygen transmittance of about 150 cc/($m^2$·24 hr.·atm·25 μm) or less and a steam transmittance of about 100 cc/($m^2$·24 hr.·atm·25 μm) or less.

4. The image supporting sheet of claim 1, wherein said clear protective film comprises a polymer selected from the group consisting of polyvinylidene chloride, polyester resin, nylon resin, polyvinyl chloride, polyvinyl fluoride and polyacrylonitrile.

5. The image supporting sheet of claim 1, wherein said clear protective film comprises an ultraviolet stabilizer.

6. The image supporting sheet of claim 5, wherein said dye receiving layer comprises at least one of a filler and a fluorescent brightening agent.

7. The image supporting sheet of claim 1, wherein said adhesive agent comprises at least one of an ultraviolet stabilizer, a photo-stabilizer, an antioxidant, and a quencher.

8. The image supporting sheet of claim 7, wherein said dye receiving layer comprises at least one of a filler and a fluorescent brightening agent.

9. The image supporting sheet of claim 1, wherein said dye receiving layer comprises at least one of an ultraviolet stabilizer, a photo-stabilizer, an antioxidant, and a quencher.

10. The image supporting sheet of claim 9, wherein said dye receiving layer comprises at least one of a filler and a fluorescent brightening agent.

11. The image supporting sheet of claim 9, wherein said ultraviolet stabilizer, said photo-stabilizer, said antioxidant and said quencher are present in a total amount of from about 0.001 to 0.70 parts by weight per 1 part by weight of said resin in said dye receiving layer.

12. The image supporting sheet of claim 1, wherein said dye receiving layer comprises at least one of a filler and a fluorescent brightening agent.

13. The image supporting sheet of claim 12, wherein said filler and said fluorescent brightening agent are present in a total amount of from about 0.001 to 0.70 parts by weight per 1 part by weight of said resin in said dye receiving layer.

14. The image supporting sheet of claim 1, wherein said releasing agent comprises at least one silicone compound.

15. The image supporting sheet of claim 14, wherein said at least one silicone compound comprises a silicone oil and a silicone resin.

16. The image supporting sheet of claim 1, wherein said releasing agent is present in an amount of from about 0.02 to 0.15 parts by weight per 1 part by weight of said resin in said dye receiving layer.

17. The image supporting sheet of claim 1, wherein said resin in said dye receiving layer has an active hydrogen and said dye receiving layer additionally comprises a crosslinking agent which reacts with said resin to form a cured dye receiving layer.

18. The image supporting sheet of claim 17, wherein said crosslinking agent comprises at least one of an isocyanate compound and a melamine resin.

19. The image supporting sheet of claim 1, wherein said adhesive agent is formed in a pattern of spots.

20. The image supporting sheet of claim 1, wherein said adhesive agent is formed in a pattern of lines.

21. The image supporting sheet of claim 1, wherein said adhesive agent is formed in a pattern of planes.

* * * * *